US007260934B1

(12) United States Patent
Roberts

(10) Patent No.: US 7,260,934 B1
(45) Date of Patent: Aug. 28, 2007

(54) EXTERNAL COMBUSTION ENGINE

(76) Inventor: John Hamlin Roberts, 213 Quarter Round Rd., Pacolet, SC (US) 29372

( * ) Notice: Subject to any disclaimer, the term of this patent is extended or adjusted under 35 U.S.C. 154(b) by 0 days.

(21) Appl. No.: 11/398,236

(22) Filed: Apr. 5, 2006

(51) Int. Cl.
*F01K 25/08* (2006.01)

(52) U.S. Cl. ..... 60/651; 60/671

(58) Field of Classification Search ..... 60/649, 60/651, 671
See application file for complete search history.

(56) References Cited

U.S. PATENT DOCUMENTS

| | | | | |
|---|---|---|---|---|
| 1,675,600 | A | 7/1928 | Doble | 122/448.1 |
| 2,379,887 | A | 7/1945 | Doble | 60/665 |
| 2,393,313 | A | 1/1946 | Doble | 60/106 |
| 2,440,328 | A | 4/1948 | Doble | 121/143 |
| 3,479,817 | A | 11/1969 | Minto | 60/36 |
| 3,670,704 | A | 6/1972 | Siewert | 122/448 S |
| 3,750,393 | A | 8/1973 | Minto et al. | 60/36 |
| 3,774,397 | A | 11/1973 | Engdahl | 60/107 |
| 4,063,420 | A | 12/1977 | Sloyan | 60/671 |
| 4,086,773 | A | 5/1978 | Kanegae et al. | 60/664 |
| 4,494,379 | A | 1/1985 | McFarland | 60/671 |
| 4,542,625 | A | 9/1985 | Bronicki | 60/641.2 |
| 4,578,953 | A | 4/1986 | Krieger et al. | 60/655 |
| 4,646,524 | A * | 3/1987 | Kawashima et al. | 62/5 |
| 4,901,531 | A * | 2/1990 | Kubo et al. | 60/618 |
| 4,942,736 | A | 7/1990 | Bronicki | 60/641.12 |
| 5,038,567 | A | 8/1991 | Mortiz | 60/641.5 |
| 5,199,262 | A | 4/1993 | Bell | 60/622 |
| 5,570,579 | A | 11/1996 | Larjola | 60/651 |
| 5,724,814 | A | 3/1998 | Ven et al. | 60/618 |
| 5,816,048 | A | 10/1998 | Bronicki et al. | 60/641.5 |
| 6,101,813 | A | 8/2000 | Sami et al. | 60/671 |
| 6,594,997 | B2 | 7/2003 | Romanelli | 60/651 |
| 6,708,687 | B2 | 3/2004 | Blackmon, Jr. et al. | 126/680 |
| 6,840,151 | B1 | 1/2005 | Barker et al. | 91/485 |
| 6,902,838 | B2 | 6/2005 | Lee et al. | 429/26 |
| 6,910,333 | B2 | 6/2005 | Minemi et al. | 60/618 |
| 6,981,377 | B2 * | 1/2006 | Vaynberg et al. | 60/641.8 |
| 2003/0213246 | A1 * | 11/2003 | Coll et al. | 60/653 |

FOREIGN PATENT DOCUMENTS

| | | |
|---|---|---|
| GB | 1301214 | 12/1972 |

OTHER PUBLICATIONS

Unknown; Organic Rankine Cycle; cogeneration.net; Sep. 30, 2005.
Unknown; Thermodynamic Power Cycles; Barber Nichols.com; Sep. 29, 2005.

* cited by examiner

*Primary Examiner*—Hoang Nguyen

(57) ABSTRACT

An organic Rankine engine used to power a vehicle is provided with a quick-start system of pumps, electric heaters or pistons to generate a pressure differential across the motor, prior to the engine reaching operating conditions.

20 Claims, 2 Drawing Sheets

EXTERNAL COMBUSTION ENGINE

BACKGROUND OF THE INVENTION

This invention relates to an improvement in an external combustion engine, suitable for use in vehicles. The engine employs an organic Rankine cycle.

Steam cars represent one of the earliest applications of external combustion engines to motor vehicles. The Stanley brothers, Francis E. Stanley and Freelan O. Stanley, pioneered the commercialization of steam cars in the United States. In 1906, a steam powered vehicle constructed by the Stanley Steam Motors Corporation set a world speed record of 127.66 mph. Another innovator in the field of external combustion engine powered vehicles was Abner Doble. His improvements to steam power plants may be found in U.S. Pat. No. 1,675,600; U.S. Pat. No. 2,379,887; U.S. Pat. No. 2,393,313; and U.S. Pat. No. 2,440,328. The external combustion engine was eclipsed, however, by the widespread adoption of the internal combustion engine.

Nevertheless, work has continued over the years to develop the external combustion engine for automobiles. An automobile incorporating an organic refrigerant as the motive or working fluid, rather than water, is disclosed in an article entitled *New: Minto's Unique Steamless "Steam" Car*, appearing in Popular Science, Volume 197, No. 4 (October 1970). A fluorocarbon refrigerant, R-113, having a boiling temperature of approximately 117° F. (47.2° C.) was identified as the preferred organic fluid. Wallace L. Minto obtained several patents on his inventions, including U.S. Pat. No. 3,479,817, U.S. Pat. No. 3,750,393, and UK Patent No. 1 303 214. The motor for converting the movement of the fluid to mechanical energy comprised fluted rotors, having flutes of different size, such as may be found in air compressors.

One of the drawbacks of powering a vehicle with an external combustion engine, especially a personal automobile, has been the engine's characteristic slow starting. For example, when a vehicle is not operating, the working fluid will gradually cool to ambient temperature, which in the summer months may be 40° C., but in the winter months may be −20° C. or lower. Consequently, when the engine is started, there is a delay in transferring heat energy from the combustion gases of the fuel to the working fluid, sufficient to raise the temperature and pressure of the working fluid to operating levels.

Another drawback of the external combustion engine is experienced when one desires to operate the vehicle for only a brief period of time, such as when rearranging cars in a parking lot. There is a large expenditure of fuel required to bring the working fluid up to operating levels, and the heat energy is lost when the vehicle is turned off and the working fluid cools to ambient temperatures.

The Rankine cycle has been disclosed for use in conjunction with an internal combustion engine (ICE) or fuel cell, to generate work from waste heat. In Kubo et al., U.S. Pat. No. 4,901,531, waste heat from an ICE is used to generate a pressurized working fluid capable of driving a piston. Lee et al., U.S. Pat. No. 6,902,838 B2, disclose using waste heat from a fuel cell to generate a pressurized working fluid to drive a shaft. In Minemi et al., U.S. Pat. No. 6,910,333 B2, waste heat from the engine is recovered with first and second Rankine cycles.

The organic Rankine cycle engine has been used to generate electrical energy from waste heat, geothermal heat or solar generated heat. Examples of such applications include U.S. Pat. No. 6,101,813; U.S. Pat. No. 5,038,567; and U.S. Pat. No. 4,942,736. Generally, such uses relate to stationary power generation, and the aforementioned shortcomings of external combustion engines are not addressed.

SUMMARY OF THE INVENTION

An object of the present invention is to provide an organic Rankine engine, with quick start-up capabilities. Another object of the invention is to provide an organic Rankine engine that is capable of delivering power, prior to the temperature and pressure of the working fluid being raised by the boiler to an operating level. Still another object of the invention is to provide a self-contained, organic Rankine engine suitable for use as the primary source of power for a vehicle, that is, the components of the engine may be mounted on a vehicle, such as a car, truck, sport utility vehicle or van.

The advantages of the improved external combustion engine of the present invention include better combustion and lower pollution, especially with regard to nitrous oxides and carbon monoxide, relative to an internal combustion engine. The external combustion engine may be powered by a wide variety of fuels, which provides greater versatility. Another advantage of the present invention is that it employs relatively low boiling temperature fluid, for example as compared to water, which makes it possible to insulate the components of the engine against heat loss, without the risk of the insulation melting or combusting. Further, the relatively low operating temperature of the present engine means that it is easier to maintain lubrication of the moving components of the motor.

The foregoing objectives, as well as other advantages and benefits, are met by the hereinafter described engine and method of its use.

An organic Rankine engine may be generally characterized as follows. An organic working fluid circulates through a closed system, where it is heated by an external source, vaporized, introduced into a motor to produce work based on a pressure differential between an intake port and an exhaust port of the motor, condensed, and then returned to the boiler, to repeat the cycle. At all times, the working fluid is contained by the equipment and tubing/piping connecting the equipment, and is not released to or in contact with the ambient air, that is, it is a closed system.

The boiler is capable of exchanging heat between the working fluid and an external heat source. Typically combustion gases generated by burning fuel comprise the external source of heat, such as when the engine provides the motive force for a vehicle. The fuel may be selected for convenience and economy. Examples of suitable fuels include methane, ethane, propane, butane, gasoline, fuel oil, fats, fatty acids, alcohols, such as ethanol, and even solid fuels, such as coal, wood chips and wood pellets, as well as combinations of the foregoing fuels.

At this time, the most practical alternative to gasoline fuel appears to be ethanol. It is a liquid, which can be pumped and handled in existing equipment used to distribute the gasoline used in internal combustion engines. As ethanol has much lower volatility and flammability than gasoline, it would be much safer to handle and can reduce air pollution significantly. Ethanol can be produced from virtually any biomass containing cellulose, hemicellulose or carbohydrates, and mixtures of the foregoing materials. A continuous potential source of ethanol is the vast quantity of paper in trash, which is buried in landfills each year.

In one example of a suitable boiler design, the working fluid flows through tubes, which are heated on the outside by combustion gases. In another example, the working fluid is provided in a vessel and combustion gases are circulated through tubes positioned in the vessel. Further examples of useful heat exchange equipment may be found in *Perry's Chemical Engineers' Handbook*, McGraw-Hill, $7^{th}$ edition (1997).

The working fluid leaving the boiler is heated to an operating level. The precise temperature and pressure of the working fluid at this point in the cycle will vary depending upon the compound selected, the pressure to operate the motor and the desired energy output of the engine. Also within the scope of the invention is the use of a reservoir between the boiler and the motor. The working fluid may leave the boiler in a liquid state and is valved into a heated reservoir and vaporized, prior to being introduced to the motor.

The motor has an intake port for receiving the working fluid from the boiler, or reservoir, as the case may be. The working fluid is introduced into the motor at a high pressure, to create mechanical energy, and exits from an exhaust port at a reduced pressure. Suitable motors include a piston engine, a turbine engine and twin-screw air rotors, as are commonly used in air compressors (except operated in reverse). The mechanical energy generated by the motor may be employed, with appropriate gears, to power a vehicle.

In a preferred embodiment of the invention, the motor comprises a plurality of pistons, each connected to a common crankshaft similar to that of the conventional internal combustion engine used in vehicles. Unlike the four-cycle internal combustion engine, which produces a power push on the pistons every other revolution of the engine, the present engine produces a power thrust every revolution. As the temperatures and maximum pressures in the cylinders in the present invention are much lower than in the internal combustion engine, much larger cylinders may be used, without problems of piston warpage and maintaining adequate lubrication. It is preferable that pistons having a diameter of six inches or more be employed. For example, high torque, low speed pistons, having a diameter of 8 inches and a throw (travel) of 6 inches, operating at 60 cycles per minute, with a pressure differential of 200 psi (pounds per square inch) between the intake and exhaust ports, will theoretically generate approximately nine horsepower.

The working fluid exits the exhaust port of the motor and is conveyed to a condenser. The condenser is capable of exchanging heat between the working fluid and an external cooling source, such as the ambient air, thereby liquefying the working fluid. Conventional fin and tube condensers may be employed. Depending on the selection of the working fluid and temperature of the external cooling source, the operating temperature, pressure and size of the condenser may vary. For example, in the case of a working fluid with a boiling temperature below the temperature of the cooling source (at 1 atmosphere of pressure), it will be necessary for the condenser to operate at a pressure sufficient to liquefy the working fluid, that is, greater than 1 atmosphere of pressure. A pump for liquids, such as a positive displacement pump, returns the condensed working fluid to the boiler, to be reheated.

Various controls and sensors are incorporated into the system to regulate the work output of the motor. A throttle valve may be located between the boiler or reservoir and the intake port of the engine, which can regulate the pressure of the working fluid furnished to the engine at any level, up to the pressure in the boiler or reservoir, thus allowing for rapid acceleration or deceleration, as needed for operation of the vehicle. In conjunction with this throttle, the rate of burning fuel, the rate at which the condensate pump operates and the rate at which the boiler vaporizes the working fluid can be regulated to maintain a constant working vapor pressure. For example, when it is desirable to increase the work output of the motor, the rate at which the working fluid is vaporized is increased by burning fuel at a higher rate. The rate of work output may be controlled with an accelerator pedal, as is typically employed in an automobile. When it is desired to decrease the work output of the motor, the flow of the working fluid to the motor may be restricted, and the rate at which the fuel is burned may be lowered.

The improvement over the traditional organic Rankine engine is the incorporation within the system of a means to create a pressure differential across the motor, thereby driving the motor, at the time the engine is started-up and prior to the temperature of the working fluid being raised in the system, to full operating level. This delay in raising the temperature of the working fluid in the boiler to full operating level is referred to as the "start-up" time and occurs within the first 30 seconds after start-up of the engine.

A pressure differential at start-up may be created by one or more of the following techniques:

(a) a pump, positioned between the boiler and the motor, capable of increasing the pressure of the working fluid at the intake port of the motor;

(b) a pump, positioned between the motor and the condenser, capable of decreasing the pressure of the working fluid at the exhaust port of the motor, for example by creating a vacuum;

(c) (i) a reservoir, located between the boiler and the intake port of the motor, capable of containing a portion of the working fluid; (ii) a check valve located between the reservoir and the boiler, capable of restricting flow of the working fluid back to the boiler; (iii) a valve for diverting the combustion gases away from the boiler and directly to the reservoir; and (iv) a heat exchanger located in the reservoir for exchanging heat between the diverted combustion gases and the working fluid in the reservoir;

(d) (i) a reservoir, located between the boiler and the intake port of the motor, capable of containing a portion of the working fluid; (ii) a check valve located between the reservoir and the boiler, capable of restricting flow of the working fluid back to the boiler; and (iii) an electrical heating element, positioned to heat the portion of the working fluid in the reservoir by at least 3° F. above, preferably at least 8° F. above, the temperature of the working fluid in the boiler; and (e) (i) a reservoir, located between the boiler and the intake port of the motor, capable of containing a portion of the working fluid; (ii) a means to contract the volume of the reservoir thereby increasing the pressure of the working fluid at the intake port of the motor, at the time of start-up; and (iii) a check valve located between the reservoir and the boiler, capable of restricting flow of the working fluid back to the boiler.

The pumps identified in (a) and (b) above may be electrical pumps capable of operating on battery power or on compressed air. Pumps for compressing air are well known in the art and include piston operated and screw type rotary air compressors. Bypass valves and piping are installed at pumps (a) and (b), to route the working fluid around the pumps, when the engine is in full operation. At start-up, when it is necessary to quickly build the pressure of the working fluid to full operating level, the bypass valves are closed and the working fluid is directed to the pump(s).

Preferably, the valves are controlled electronically, based on feedback from sensors located throughout the system, in particular, by measuring the temperature and pressure of the working fluid leaving the boiler.

The reservoir in (c) above functions to isolate a portion of the working fluid from the bulk of the working fluid to be heated in the boiler. Accordingly, at the time the engine is started-up, the combustion gases from the burner, which would otherwise be circulated through the boiler, are diverted to the reservoir. The reservoir has a heat exchanger, to exchange the heat from the combustion gases with the portion of the working fluid in the reservoir. A check valve between the reservoir and the boiler prevents the working fluid from flowing back to the boiler, when the pressure in the reservoir builds. The combustion gases exiting the reservoir may be circulated back to the boiler. Also, the flow of combustion gases from the burner may be divided, that is, some of the gases may be diverted directly to the reservoir, and the remaining flow of combustion gases may be delivered to the boiler. Electronically controlled valves, responding to temperature sensors in the system, can optimize the division of combustion gases between the reservoir and boiler.

The electrical heating element identified in (d) above may be battery powered. In a preferred embodiment, the heating elements are placed on the inside of the reservoir, to maximize heat transfer from the heating element to the working fluid in the reservoir.

The means to contract the volume of the reservoir to increase the pressure of the working fluid may be a piston, such as a spring loaded piston or an air pressure regulator, which is forced to a biased position by pressure built up during the operation of the engine, and sealed by closing a valve when the engine is turned off. When one desires to start the engine, the valve is opened and the piston is released to contract the volume in the reservoir. Alternatively, the reservoir may contain a resilient bladder, which is filled with air or other gas, under pressure, which at ambient temperatures are so far above their critical temperatures that minor changes in temperature have little effect on their pressure. When the engine is operating, the bladder will be compressed until the air pressure matches the pressure of the working fluid in the reservoir. When the engine is turned off and the pressure in the reservoir decreases, the bladder will expand, increasing the pressure of the fluid to a start-up level.

In one embodiment of the invention, a vortex tube is incorporated into the system. Vortex tubes are well known in the art, as is their ability to fractionate a compressed gas stream into a cold gas and hot gas streams. After the somewhat cooled combustion gases leave the boiler, they are fed to a pump, and in turn to a vortex tube. The pump compresses the combustion gases to a pressure of about 50 to 150 psig. The pump may be electrically or mechanically powered, for example by power generated by the motor. The compressed gases enter the side of the vortex tube and separate into a cold stream (fraction) and a hot stream (fraction), which exit opposite ends of the tube. The vortex tube may be adjusted to vary the cold fraction from about 50% to 80% of the incoming flow. With the vortex tube it is possible to achieve cold fractions having a temperature as low as −50° F. (−46° C.).

The cold fraction of combustion gases is used to condense the working fluid, after the working fluid exits the motor. The cold fraction may be mixed with air used to cool the working fluid in the condenser. The hot fraction of gases leaving the vortex tube may be used to heat the working fluid on the intake side of the motor, that is, between the condensate pump and the motor.

It is not necessary for practicing the present invention that all of the above mentioned techniques (a)-(e) be employed in a single system. For example, either pump (a) or pump (b) or both could be used, with or without a reservoir. The pumps could be used in conjunction with any of the reservoir designs (c)-(e). Further, it is possible to direct the combustion gases directly to the reservoir as described in technique (c), while also employing an electric heater in the reservoir as disclosed in technique (d). Thus, any of the techniques (a)-(e) may be used in combination with one or more of the other techniques.

Generally, the working fluid is a compound or composition that can be evaporated and condensed in the engine system to produce work. The working fluid preferably has a critical temperature above 40° C., so that with sufficient pressure, the fluid may be condensed with ambient air. In one embodiment of the invention, the working fluid has a boiling point of 25° C. or less, at 1 atmosphere of pressure.

Examples of organic compounds suitable for use as a working fluid may be found in the class of compounds identified generally as refrigerants, including halogenated hydrocarbons and alcohols, in particular chloro- and fluoro-substituted methane, ethane, propane, methanol, ethanol (such as trifluoroethanol) and propanol, and hydrochlorofluorocarbons (HCFCs). The working fluid may be ammonia, aqueous ammonia or sulfur dioxide. Preferably the working fluid is a tetrafluoroethane refrigerant, such as 1,1,2,2-tetrafluoroethane (R134) or 1,1,1,2-tetrafluoroethane (R134A), which are currently approved by the United States Environmental Protection Agency for use in refrigeration/air conditioning systems.

It is important that at all points in the system where one desires to maintain the working fluid at a relative high pressure and temperature above 50° C., for example between boiler 6 and motor 16, the components are well insulated.

DETAILED DESCRIPTION OF THE INVENTION

Without limiting the scope of the invention, the preferred embodiments and features are hereinafter set forth. All of the United States patents, which are cited in the specification, are hereby incorporated by reference.

Figure 1:
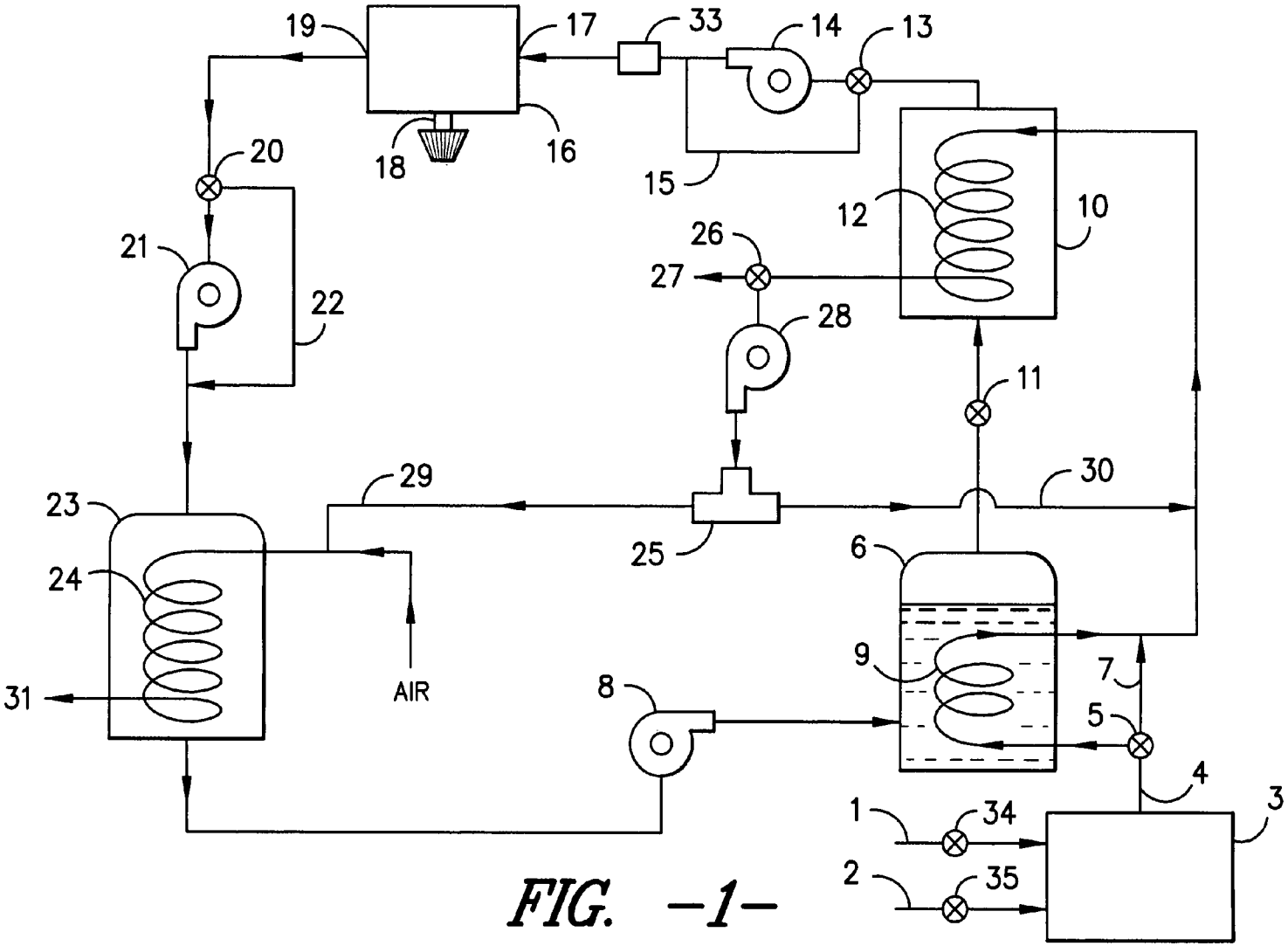
FIG. 1 is a diagram of the organic Rankine cycle engine, with the three of the means for creating a pressure differential across the motor during start-up illustrated.

Referring to FIG. 1, fuel stream 1 and air stream 2 are fed to burner 3 to produce combustion gas stream 4. Valve 5 controls the flow of the combustion gases, which may be diverted all or partially to boiler 6 or bypass 7. Working fluid (liquid state) is fed by pump 8 to boiler 6, where it is heated by the combustion gases. The combustion gases circulate through the heat exchange equipment in boiler 6, shown as coils 9, before passing on to reservoir 10. Any of the combustion gases passing through bypass 7 pass on to reservoir 10. When the engine is first started-up, bypass valve 5 opens to divert a substantial portion of the combustion gases directly to reservoir 10, thereby rapidly heating the working fluid contained therein. In an alternative embodiment, the combustion gas stream 4 may be routed directly to pump 28, located in front of vortex tube 25 (not shown).

During regular operation of the engine (post start-up), the working fluid exits boiler 6, through check valve 11, and into reservoir 10. Check valve 11 allows only for one-way flow between boiler 6 and reservoir 10. The combustion gases pass through coils 12, further heating the working fluid in reservoir 10. By way of example, the working fluid is R134A refrigerant, and may be raised to a temperature of 150° to 200° F. and a pressure of from 250 to 400 psi. The working fluid passes from reservoir 10, to valve 13, which controls the flow of working fluid, between pump 14 and bypass 15. Pump 14 comprises one means to quickly generate power for motor 16 at the time of start-up, by compressing the working fluid to sufficient pressure to drive motor 16. Once the system reaches its operating level, valve 13 diverts the flow of working fluid to bypass 15.

The working fluid flows from pump 14 or bypass 15 (or both) to intake port 17 of motor 16. The working fluid is in the gas state as it enters motor 16, and the pressure of the working fluid exerts sufficient force to generate mechanical work, by conventional means, such as by turning shaft 18 connected to gears, transmissions, differentials, etc. The working fluid exits motor 16 through exhaust port 19.

Next, the working fluid (gas state) flows to valve 20, which controls the flow to pump 21 or bypass 22. Pump 21 comprises the means to quickly generate power from motor 16 at the time of start-up, by compressing the working fluid downstream of motor 16, creating a partial vacuum upstream, to decrease the pressure of the working fluid at exhaust port 19, thereby creating a pressure drop across motor 16. Once the system reaches its operating level, valve 20 diverts the flow of working fluid to bypass 22.

The working fluid then flows to condenser 23, where heat is removed by a cooling source, such as air being blown through coils 24 of condenser 23 (blower not shown). The working fluid exits condenser 23 as a liquid, and the working fluid is recycled back to boiler 6 by pump 8. In one embodiment, condenser 23 may be configured similar to a conventional automobile radiator, relying on the motion of the vehicle to supply cooling air to the condenser.

An additional cooling source for condenser 23 is vortex tube 25. When the partially cooled combustion gases exit coils 12 in reservoir 10, they are conveyed to valve 26, which directs the combustion gases to exhaust duct 27, or to pump 28, where the gases are compressed before entering vortex tube 25, or the combustion gases are divided between exhaust duct 27 and pump 28, depending on the demand for cooling, discussed further below. The compressed combustion gases are split by vortex tube 25 into a cold fraction 29 and a hot fraction 30. Cold fraction 29 is directed to coils 24, and out exhaust duct 31. And, hot fraction 30 is recycled with the combustion gases from boiler 6 to reservoir 10. Alternatively, the combustion gases are recycled to boiler 6 (not shown).

Throttle 33 is incorporated in the engine cycle before intake valve 17 of motor 16, to control the pressure of the gaseous working fluid. By regulating the gas pressure to motor 16, the power output of the engine may be rapidly adjusted. Additionally, the flow of fuel stream 1 and air stream 2 to burner 3 are controlled by valves 34 and 35, respectively. The operation of throttle 33, valve 34 and valve 35 may be electronically linked to the acceleration controls of a vehicle, to work in concert.

When the engine is shut off, throttle 33, as well as valve 13, can be closed to maintain the pressure of the working fluid. Then, when the engine is started-up, throttle 33 and valve 13 are opened, to allow the pressurized fluid to drive motor 16.

Figure 2:
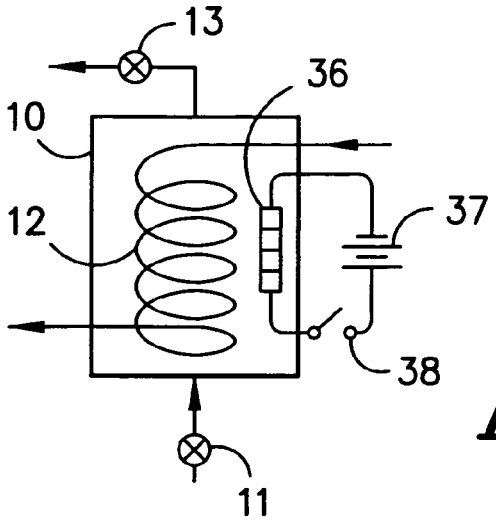
FIG. 2 is a diagram of an embodiment of the reservoir having an electrical heating element positioned therein.

Referring to FIG. 2, in one embodiment of the invention, reservoir 10 is provided with heating element 36, connected to battery 37. Heating element 36 is activated by closing switch 38. When the engine is turned off, check valve 11 and valve 13 retain the working fluid in reservoir 10. As the working fluid cools to ambient pressure, its pressure decreases. Nevertheless, it is possible to maintain a start-up pressure in reservoir 10, by insulating it well and by activating heating element 36 when the engine is turned off. It is believed that by maintaining the temperature of the working fluid in reservoir 10 at a temperature of at least 5° F. above ambient temperature, preferably at least 10° F. above ambient temperature, sufficient pressure differential is created to instantly power the engine at start-up.

It can be understood that the timing of the activating heating element may be varied to conserve energy. For example, heating element 36 may be activated by remote control, a short time prior to using a vehicle having the subject engine, as may be done with remote starters for internal combustion engines. Alternatively, after the engine is turned off, heating element 36 can be activated for a period of limited duration, such as 24 hours, during which time the vehicle may be ready to operate, without delay.

Figure 3:
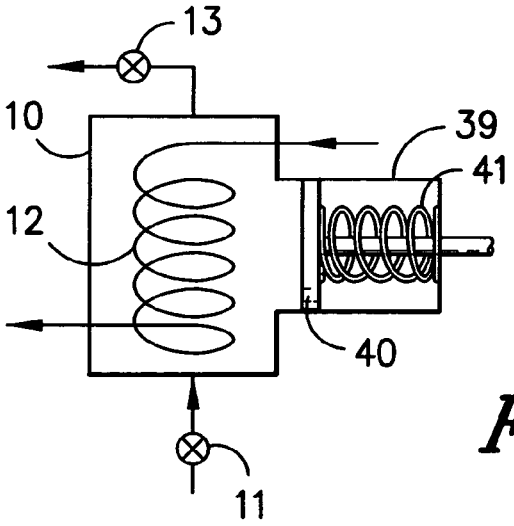
FIG. 3 is a diagram of an embodiment of the reservoir having a spring loaded piston, to contract the volume of the reservoir.

Referring to FIG. 3, in another embodiment of the invention, the volume of reservoir 10 includes cylinder 39, in which piston 40 travels. Spring 41 forces piston 40 inward, contracting the volume of reservoir 10. Alternatively, in place of a spring, piston 40 may be biased inward to contract the volume of reservoir 10 by a compressed gas (not shown), such as is employed in an automobile shock absorber. While the engine is in operation, however, the pressure in reservoir 10 causes piston 40 to retract, thereby expanding the volume of reservoir 10. When the engine is turned off, check valve 11 and valve 13 close to hold the working fluid in reservoir 10. At the time of start-up, valve 13 is opened and spring 41 forces piston 40 inward, contracting the volume of reservoir 10 and forcing the working fluid through the system and powering motor 16.

Figure 4:
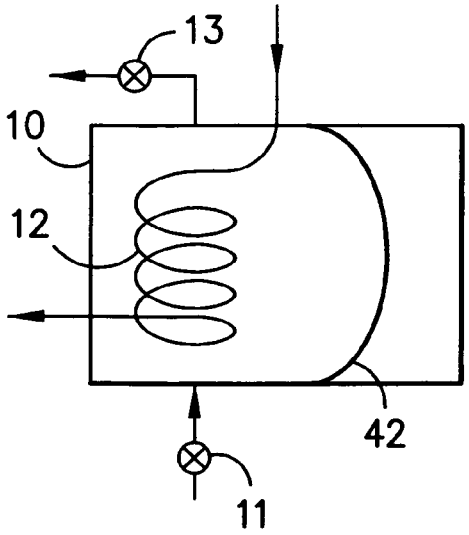
FIG. 4 is a diagram of an embodiment of the reservoir having an expandable bladder, whereby the volume of the reservoir can expand and contract.

Referring to FIG. 4, in still another embodiment of the invention, the volume of reservoir 10 includes an expandable bladder 42, constructed out of an elastomeric material. While the engine is in operation, bladder 42 contracts from the pressure, thereby increasing the volume of reservoir 10. When the engine is turned off, check valve 11 and valve 13 close to hold the working fluid in reservoir 10, and, as the working fluid in reservoir 10 cools, bladder 42 will expand inwardly until the pressure is equalized.

The improved organic Rankine cycle engine of the present invention is believed to be particularly useful mounted on a vehicle as the primary power source, such as cars, trucks, sport utility or a railway locomotive. For safety's sake, some or all of the components containing the working fluid under pressure may be equipped with "pop-off" valves, actuated by vehicle impact, to eliminate the danger of explosions in the event of a catastrophic collision involving the vehicle.

The invention may be further understood by reference to the following claims.

I claim:

1. An organic Rankine cycle engine comprising:

(a) an organic working fluid;

(b) a boiler capable of exchanging heat between the working fluid and an external heat source and raising the temperature of the working fluid;

(c) a motor, having an intake and an exhaust port, capable of being driven by the working fluid, whereby the working fluid enters the intake port and exits the exhaust port in a gaseous state;

(d) a condenser capable of exchanging heat between the working fluid and an external cooling source and lowering the temperature and pressure of the working fluid, whereby the working fluid is liquefied;

(e) a first pump capable of transporting the liquid working fluid from the condenser to the boiler, under pressure; and (f) a means to create a pressure differential across the motor, thereby driving the motor, at start-up, selected from the group consisting of:

(i) a second pump, positioned between the boiler and the condenser, and a bypass valve and piping for routing the working fluid around the second pump, when the engine is in full operation; and (ii) a reservoir, located between the boiler and the intake port of the motor, capable of isolating a portion of the working fluid from the bulk of working fluid to be heated in the boiler; a check valve located between the reservoir and the boiler, capable of restricting the flow of the working fluid back to the boiler; and a means to selectively increase the pressure of the working fluid in the reservoir, thereby increasing the pressure of the working fluid at the intake port of the motor.

2. The engine according to claim 1, wherein the second pump, bypass valve and piping to create a pressure differential across the motor is positioned between the boiler and the motor, and is capable of increasing the pressure of the working fluid at the intake port of the motor.

3. The engine according to claim 1, wherein the second pump, bypass valve and piping to create a pressure differential across the motor is positioned between the motor and the condenser, and is capable of decreasing the pressure of the working fluid at the exhaust port of the motor.

4. The engine according to claim 1, wherein the means to create a pressure differential comprises the second pump, bypass valve and piping positioned between the boiler and the motor, capable of increasing the pressure of the working fluid at the intake port of the motor, and a third pump, bypass valve and piping positioned between the motor and the condenser, capable of decreasing the pressure of the working fluid at the exhaust port of the motor, wherein the second and third pumps operate on battery power.

5. The engine according to claim 1, wherein the reservoir, check valve and means to increase the pressure of the working fluid in the reservoir to create a pressure differential across the motor further comprises an electrical heating element, positioned to transfer heat to the portion of the working fluid in the reservoir.

6. The engine according to claim 1, wherein the reservoir, check valve and means to increase the pressure of the working fluid in the reservoir to create a pressure differential across the motor further comprises a means to contract the volume of the reservoir thereby increasing the pressure of the working fluid at the intake port of the motor, at the time of start-up.

7. The engine according to claim 1, wherein the external heat source is combustion gases generated by a burner, and the reservoir, check valve and means to increase the pressure of the working fluid in the reservoir to create a pressure differential across the motor further comprises a valve and piping for directing combustion gases directly to the boiler and for diverting combustion gases away from the boiler and directly to the reservoir; and a heat exchanger located in the reservoir for exchanging heat between the diverted combustion gases and the working fluid in the reservoir.

8. The engine of claim 1, wherein the external heat source supplied to the boiler comprises combustion gases, wherein the combustion gases are (i) directed to a heat exchanger in the boiler, and then (ii) directed to a vortex tube, to produce a cold gas stream and a hot gas stream, and the hot gas stream is used to heat the working fluid, prior to the working fluid entering the intake port of the motor, and the cold gas stream is used to condense the working fluid, after the working fluid exits the exhaust port of the motor.

9. The engine of claim 1, wherein the working fluid has a boiling point of 25° C. or less, at 1 atmosphere of pressure.

10. The engine of claim 1, wherein the engine is a reciprocating piston driven engine.

11. The engine of claim 10, wherein the engine has a plurality of pistons.

12. The engine of claim 11, wherein the pistons have a diameter of at least six inches.

13. A method of starting-up an organic Rankine engine, having an organic working fluid, a boiler, a motor, a condenser and a first pump for transporting the liquid working fluid from the condenser to the boiler, under pressure, comprising the step of creating a pressure differential across an intake port and an exhaust port of the motor, prior to the temperature of the working fluid being raised by the boiler to an operating level, wherein the pressure differential is created by one or more of the techniques selected from the group consisting of (a) increasing the pressure of the working fluid at the intake port of the motor with an intake pump, positioned between the boiler and the motor;

(b) decreasing the pressure of the working fluid at the exhaust port of the motor with an exhaust pump, positioned between the motor and the condenser;

(c) providing (i) an external heat source of combustion gases generated by a burner, (ii) a reservoir, located between the boiler and an intake port of the motor, capable of containing a portion of the working fluid; (ii) a check valve located between the reservoir and the boiler, capable of restricting flow of the working fluid back to the boiler; (iii) a valve for diverting the combustion gases away from the boiler and directly to the reservoir; and (iv) a heat exchanger located in the reservoir for exchanging heat between the diverted combustion gases and the working fluid in the reservoir;

(d) providing a reservoir, located between the boiler and the intake port of the motor, capable of containing a portion of the working fluid, a check valve located between the reservoir and the boiler, capable of restricting flow of the working fluid back to the boiler; and an electrical heating element, positioned to rapidly transfer heat to the portion of the working fluid in the reservoir, and heating the portion of the working fluid, thereby increasing the pressure of the working fluid at the intake port of the motor; and (e) providing a reservoir, located between the boiler and the intake port of the motor, capable of containing a portion of the working fluid, a means to contract the volume of the reservoir and a check valve located between the reservoir and the boiler, capable of restricting flow of the working fluid back to the boiler, and contracting the volume of the reservoir, thereby increasing the pressure of the working fluid at the intake port of the motor.

14. The method of claim 13, wherein the pressure differential is created by increasing the pressure of the working fluid at the intake port of the motor with an intake pump, positioned between the boiler and the motor, and further comprising the step of bypassing the working fluid around the intake pump when the engine is at a full operating level.

15. The method of claim 13, wherein the pressure differential is created by decreasing the pressure of the working fluid at the exhaust port of the motor with an exhaust pump, positioned between the motor and the condenser, and further comprising the step of bypassing the working fluid around the exhaust pump when the engine is at a full operating level.

16. The method of claim 13, wherein the pressure differential is created by providing a reservoir, located between the boiler and the intake port of the motor, capable of containing a portion of the working fluid, a check valve located between the reservoir and the boiler, capable of restricting flow of the working fluid back to the boiler; and an electrical heating element, positioned to rapidly transfer heat to the portion of the working fluid in the reservoir, and heating the portion of the working fluid with the heating element, thereby increasing the pressure of the working fluid at the intake port of the motor.

17. The method of claim 13, wherein the pressure differential is created by providing a reservoir, located between the boiler and the intake port of the motor, capable of containing a portion of the working fluid, a means to contract the volume of the reservoir and a check valve located between the reservoir and the boiler, capable of restricting flow of the working fluid back to the boiler, and contracting the volume of the reservoir, thereby increasing the pressure of the working fluid at the intake port of the motor.

18. The method of claim 13, further comprising the steps of (i) burning a fuel to create combustion gases; (ii) directing the combustion gases to a heat exchanger in the boiler, and (iii) directing the combustion gases to a vortex tube, to produce a cold gas stream and a hot gas stream, the hot gas stream is used to heat the working fluid, prior to the working fluid entering an intake port of the motor, and the cold gas stream is used to condense the working fluid, after the working fluid exits the exhaust port of the motor.

19. The method of claim 13, wherein the means to create a pressure differential across the motor comprises providing (i) an external heat source of combustion gases generated by a burner, (ii) a reservoir, located between the boiler and an intake port of the motor, capable of containing a portion of the working fluid; (ii) a check valve located between the reservoir and the boiler, capable of restricting flow of the working fluid back to the boiler; (iii) a valve for diverting the combustion gases away from the boiler and directly to the reservoir; and (iv) a heat exchanger located in the reservoir for exchanging heat between the diverted combustion gases and the working fluid in the reservoir.

20. The engine of claim 13, wherein the working fluid has a boiling point of less than 25° C., at 1 atmosphere of pressure.

* * * * *